US005299435A

United States Patent [19]

Whalley

[11] Patent Number: 5,299,435

[45] Date of Patent: Apr. 5, 1994

[54] LOCKED INLAY KNIT FABRICS

[75] Inventor: Sylvan A. Whalley, Chaddesden, United Kingdom

[73] Assignee: Courtaulds PLC, United Kingdom

[21] Appl. No.: 778,903

[22] PCT Filed: Jul. 10, 1990

[86] PCT No.: PCT/GB90/01060

§ 371 Date: Jan. 10, 1992

§ 102(e) Date: Jan. 10, 1992

[87] PCT Pub. No.: WO91/00936

PCT Pub. Date: Jan. 24, 1991

[30] Foreign Application Priority Data

Jul. 11, 1989 [GB] United Kingdom ..... 8915888

[51] Int. Cl.[5] ..... D04B 1/00

[52] U.S. Cl. ..... 66/61; 66/64; 66/190

[58] Field of Search ..... 66/9 R, 61, 190, 64, 66/196–198

[56] References Cited

U.S. PATENT DOCUMENTS

| | | | |
|---|---|---|---|
| 616,524 | 12/1898 | Cartledge | 66/190 |
| 782,480 | 2/1905 | Benndorf | 66/61 |
| 2,069,819 | 2/1937 | Diem | 66/61 X |
| 2,108,925 | 2/1938 | Raynor | 66/190 |
| 2,236,758 | 4/1941 | Lumsden | 66/190 |
| 3,685,316 | 8/1972 | Robinson et al. | 66/64 |
| 3,774,412 | 11/1973 | Schichman | 66/9 R |

FOREIGN PATENT DOCUMENTS

| | | | |
|---|---|---|---|
| 705541 | 5/1941 | Fed. Rep. of Germany . | |
| 2047566 | 4/1971 | Fed. Rep. of Germany . | |
| 38-220990 | 5/1963 | Japan . | |
| 6939 | of 1905 | United Kingdom | 66/64 |
| 26249 | of 1905 | United Kingdom | 66/64 |
| 2121837 | 4/1984 | United Kingdom . | |

*Primary Examiner*—Clifford D. Crowder
*Assistant Examiner*—John J. Calvert
*Attorney, Agent, or Firm*—Davis Hoxie Faithfull & Hapgood

[57] ABSTRACT

A method of knitting a double needle bed fabric in which an inlay thread or yarn 12 is interlaced into the fabric by transferring stitches from the active needles (10) of one needle bed to the needles of the other bed. In this way the inlay 12 is interlaced or "woven" into the fabric without actually forming loops in the inlay 12. This enables materials that cannot be knitted to be incorporated into fabrics securely.

13 Claims, 6 Drawing Sheets

LOCKED INLAY KNIT FABRICS

TECHNICAL FIELD

This invention relates to methods of knitting and in particular to the knitting of inlaid fabrics. The present invention is relevant to the knitting of fashion knitwear and to the knitting of industrial fabrics and structural composites, as will be explained hereinafter in greater detail.

In the knitting of fashion knitwear, it is well known to form aesthetic patterns by knitting the fabric on two beds of needles, (either on flat bed machines, V-bed machines or on circular bed knitting machines), and transferring stitches from selected needles of one bed to selected needles of the other bed. This knitting technique is often referred to as transfer stitch knitting. Whilst it is possible to produce some very pleasing effects with this technique, transfer stitch knitting tends to be very slow compared with other forms of weft knitting. Double jersey is knitted on twin bed machines and again some pleasing results can be obtained by transferring stitches from selected needles of one bed to selected needles of the other bed.

A further well known knitting technique is that of inlaying strands of another yarn to produce an inlaid fabric. An inlaid fabric consists of a ground structure of knitted looped threads which hold in position, a non-knitted thread, which is laid into the knitted structure during the same knitting cycle. The inlaid fabric is trapped inside a double needle bed fabric by the loops or overlaps and towards the back of the single needle bed fabrics by the sinker loops or underlaps.

Usually in double needle bed fabrics, the inlaid yarn is not very visible from the front or back of the fabric and is not knitted into the fabric (it can be pulled out of the fabric with little difficulty).

Laying-in a yarn offers the possibility of introducing fancy, unusual, inferior or superior yarns whose physical properties such as thickness, weakness, irregular surface or cross sectional area, elasticity or lack of elasticity render them difficult for knitting in the normal manner.

An object of the present invention is to provide a novel inlaid double needle bed fabric in which an inlay thread or yarn is "interlaced" or "woven" into the fabric during the knitting cycle.

The terms "interlaced" and "woven" are taken to refer to the unique action of the present invention where during the knitting cycle, one course is knitted, an inlay thread is inlaid (in the sense as practised in the past) but is immediately interlaced into the fabric by cross transferring stitches from one bed to the other. Thus the inlaid thread or yarn is not knitted as part of the loops of the ground structure.

SUMMARY OF THE INVENTION

The invention as claimed in the following claim 1 produces a double needle bed fabric in which an inlay thread or yarn is first laid in and then interlaced or woven into the fabric by transferring stitches from the needles of one needle bed to the needles of the other needle bed.

BRIEF DESCRIPTION OF THE DRAWINGS

Embodiments of the present invention will now be described by way of example, with reference to the accompanying drawings in which.

DESCRIPTION OF PREFERRED EMBODIMENTS

In all of the following embodiments, the fabrics were knitted on double needle bed weft knitting machines. The machines were either conventional flat or V-bed machines or circular rib machines. All machines have needle to needle stitch transfer facility for transferring to and from the needle beds as will be explained in greater detail.

Figure 1A:
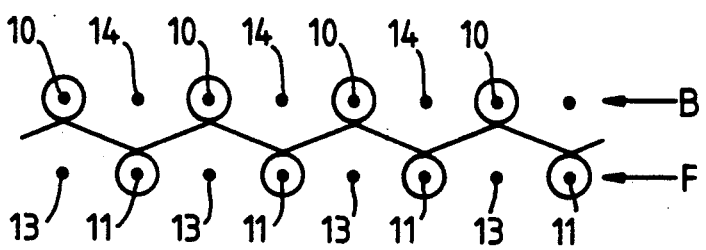
FIGS. 1*a* to 5*h* illustrate schematically the stitch patterns of four fabrics made in accordance with the present invention.
Figure 1B:
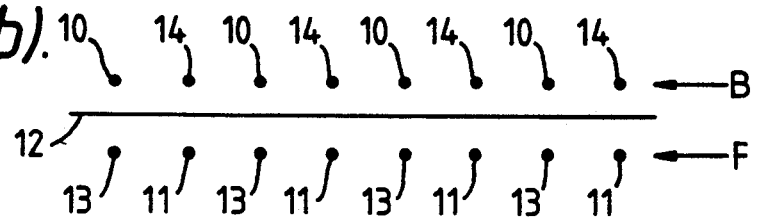
Figure 1C:
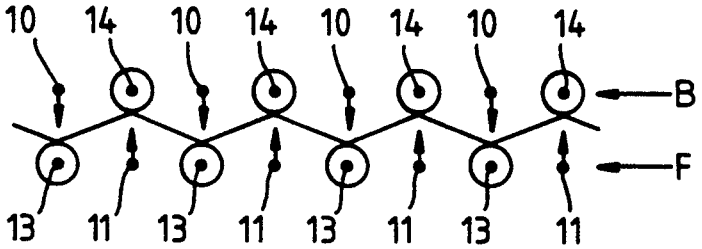
Figure 1D:
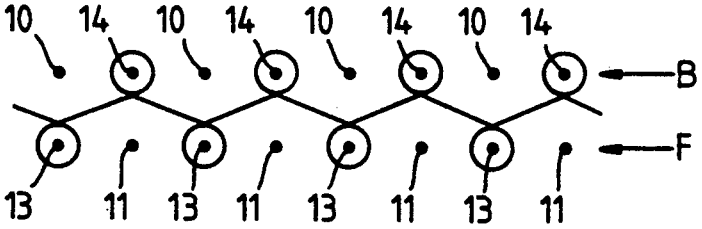
Figure 1E:
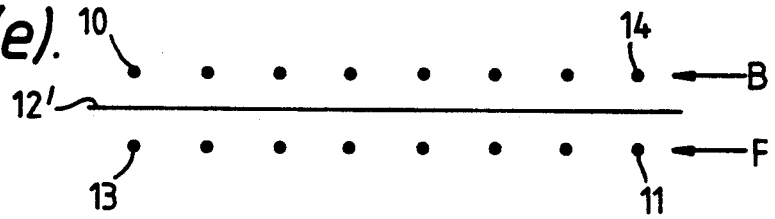
Figure 1F:
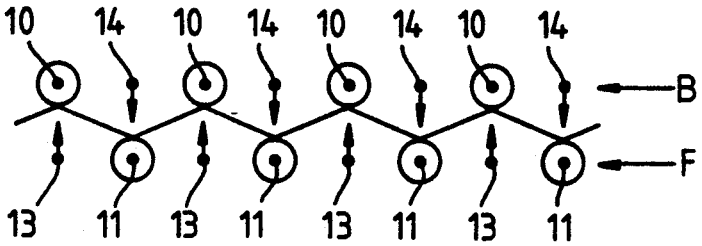

Referring to FIG. 1 a ground structure was knitted using 400 decitex polyamide aramid thread or yarn (such as "Kevlar", a trade mark of Du Pont). The needle beds B and F were set at half gauge and the first course was knitted on alternate needles 10 (the active needles) of the back bed of needles B and on the alternate needles 11 (the active needles) of the front bed F that lie opposite the inactive needles 14 of the back bed, as shown in (a) of FIG. 1. An inlay thread or yarn, 12, which in this example was typically 2000 decitex glass fibre yarn, was inlaid in much the same way as has been done in the past as shown in (b) of FIG. 1. The inlaid yarn 12 is incorporated, or "woven" into the fabric in accordance with the present invention by transferring all the stitches from the active needles 10 of the back bed B of needles to the inactive needles 13 of the front bed F and at the same time transferring the stitches from the active needles 11 of the front bed F to the inactive needles 14 of the back bed B. This stitch transfer is shown in (c) of FIG. 1.

The transferred stitches are then knitted as shown in (d) of FIG. 1, and then the same or a different inlay yarn 12' is laid into the fabric as shown in (e) of FIG. 1. This inlaid yarn 12' is again woven into the fabric by transferring all the stitches from the active needles 13 to the inactive needles 10 and from the active needles 14 to the inactive needles 11.

Steps (e) to (f) of FIG. 1 are repeated as often as required to produce a fabric of the desired length and the stitches are finally cast off or sealed with a heat sealable yarn. The resulting fabric was almost indistinguishable from a woven fabric in that the inlaid yarn (12, 12') appeared at both faces of the fabric and appeared to be passing over and under adjacent whales.

Figure 2E:
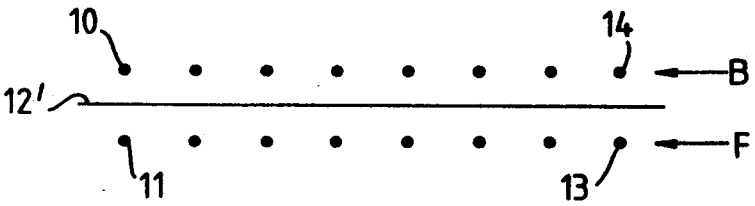
Figure 2F:
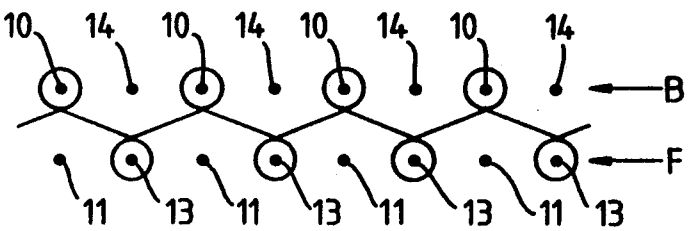
Figure 2G:
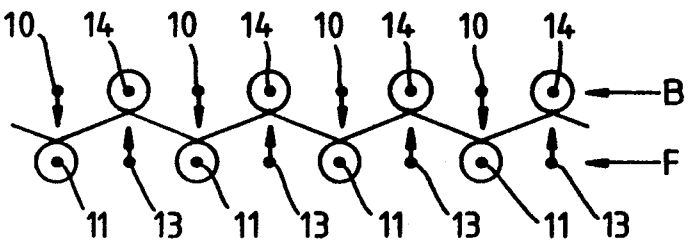
Figure 2A:
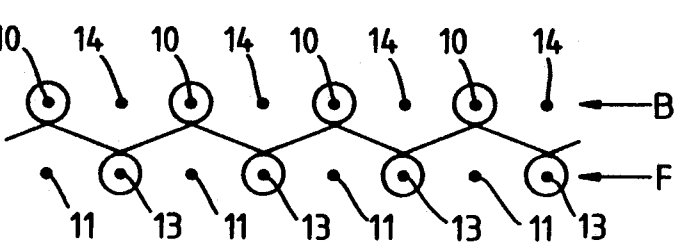
Figure 2B:
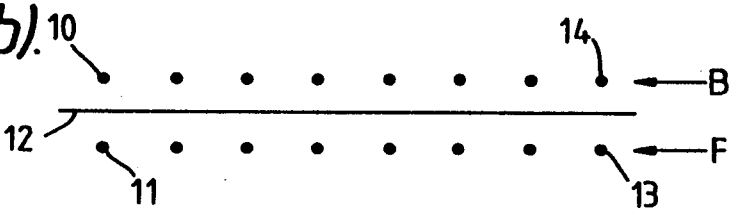
Figure 2C:
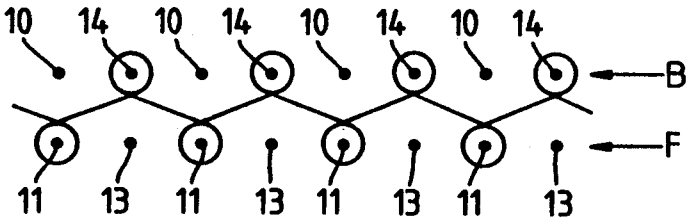
Figure 2D:
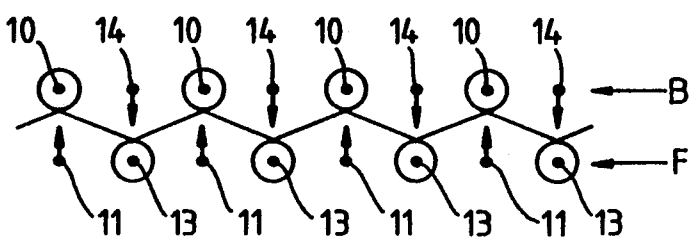

Referring to FIG. 2, the knitting cycle of FIG. 1 was varied slightly but the same yarns and threads were used for the knitted ground structure and the inlay yarn 12. In the method of knitting shown in FIG. 2 the needles were set at half gauging (sometimes called interlock gauging). A first course was knitted as shown in (a) of FIG. 2 by knitting alternate needles 10 and the alternate needles 13 of the back B and front F beds respectively.

The inlay yarn 12 was then laid in as before, as shown in (b) of FIG. 2 and all the stitches on needles 10 and 13 were knitted over the inlay yarn onto needles 11 and 14 as shown in (c) of FIG. 2. All the knitted stitches were transferred to the opposite needles of the other bed as shown in (d) of FIG. 2 in order to "weave" the inlay into the knitted fabric.

A second course of inlay material 12' was laid into the fabric as shown in (e) and all stitches were knitted (as a 1×1 rib) over the inlaid material as shown in (f) of FIG. 2. All stitches on needles 10 were transferred to needles 11 and at the same time all stitches on needles 13 were transferred to needles 14 as shown in (g) of FIG. 2. Steps (b) to (g) were repeated until the desired length of fabric was produced.

Figure 3A:
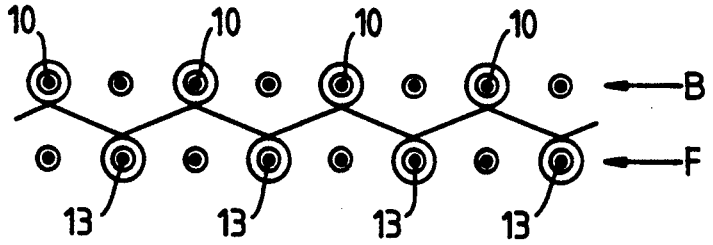
Figure 3B:
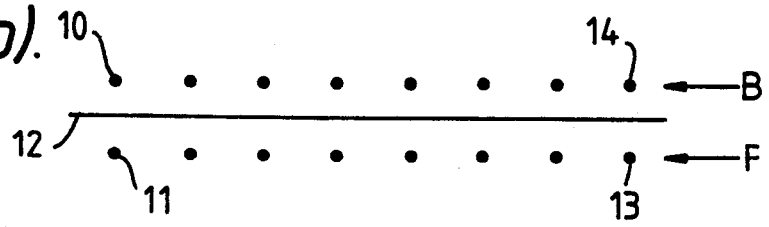
Figure 3C:
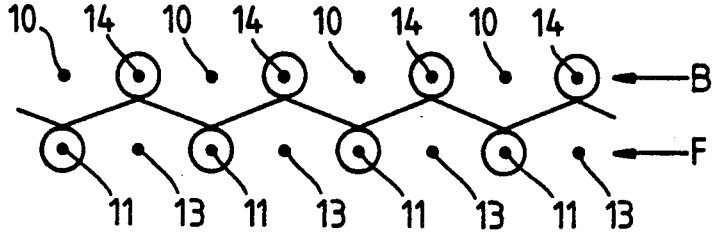
Figure 3D:
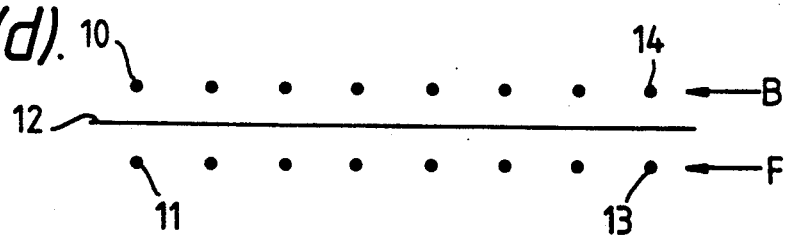
Figure 3E:
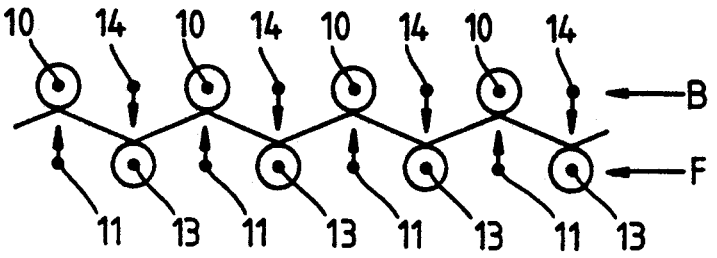
Figure 3F:
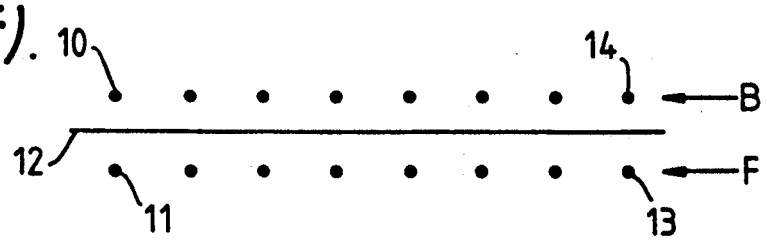
Figure 3G:
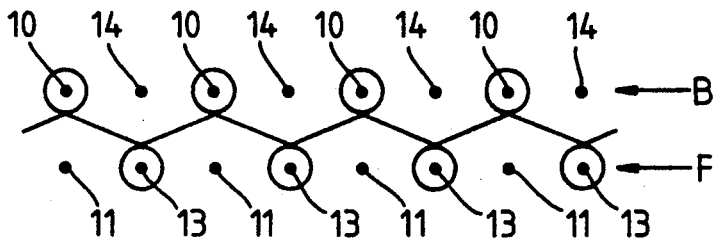
Figure 3H:
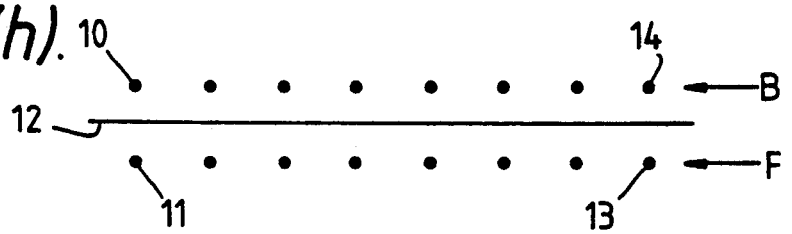
Figure 3I:
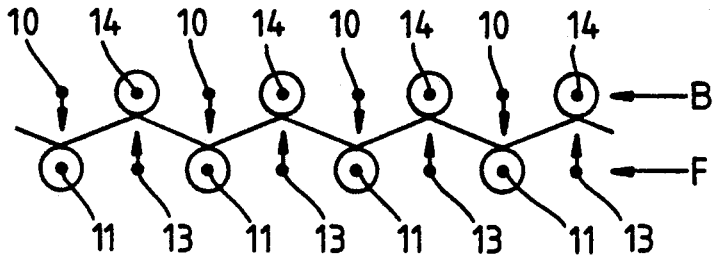

Referring to FIG. 3 there is shown a method of knitting in accordance with the present invention which is a combination of the methods of FIGS. 1 and 2. The method of FIG. 3 comprises the step of knitting a first course on the needles 10 of the back bed B and the needles 13 of the front bed F as shown in (a) of FIG. 3.

The inlay material 12 is laid in at step (b) and the stitches on needles 11, 14 are knitted. A second course of inlay material 12 is then laid into the fabric as shown in (d) and then all the stitches on the needles of the front bed F are transferred to the needles of the back bed B and the stitches on the needles of the back bed B are transferred to the needles of the front bed F. This stitch transfer has the effect of weaving into the fabric every other one of the inlaid yarns 12 and leaving the other courses of the inlaid yarn not woven into the fabric.

Figure 4A:
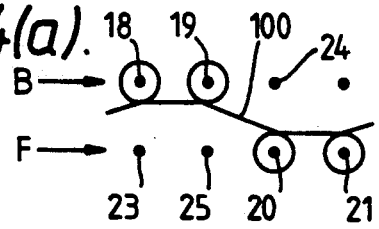
Figure 4B:
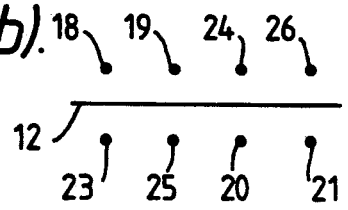
Figure 4C:
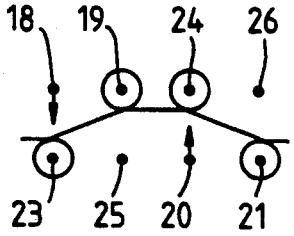
Figure 4D:
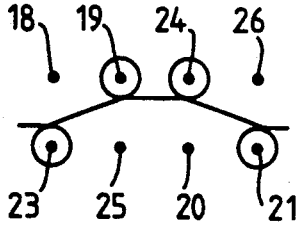
Figure 4E:
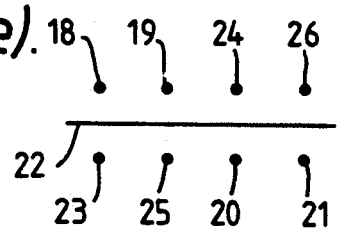
Figure 4F:
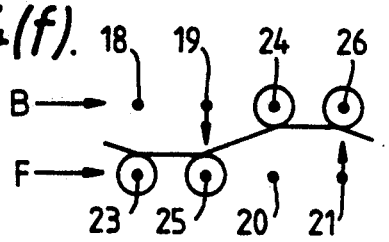
Figure 4G:
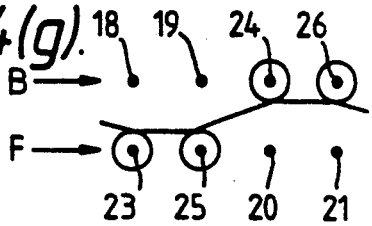
Figure 4H:
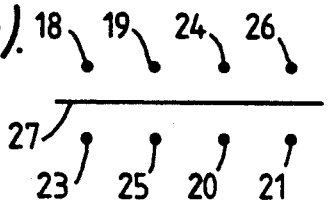
Figure 4I:
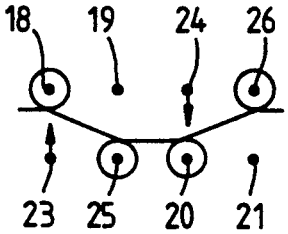
Figure 4J:
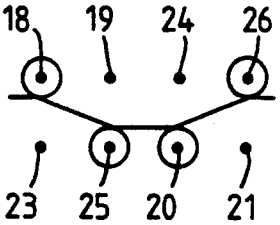
Figure 4K:
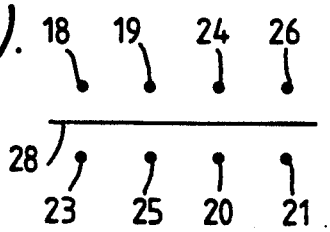
Figure 4L:
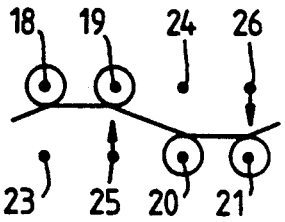

Referring to FIG. 4 there is shown a method of knitting a simulated 2×2 twill fabric. The thread for the knitted ground structure is a 400 decitex thread and the inlay material 12 is 2000 decitex fibres to produce a fashion knitwear product.

One course of thread 100 is knitted on alternate pairs of needles 18, 19 on the back bed B of needles and needles 20, 21 on the front bed F of needles as shown in (a) then one course of inlay yarn 12 is laid into the fabric as shown at (b). The stitches on one (18) of each of the pairs of needles la, 19 are transferred to needle 23 on the front bed and at the same time the stitches on one (20) of each of the pairs of needles 20, 21 are transferred to needle 24 on the back bed of needles. This cross transfer of one stitch of each pair to the other bed effectively weaves the inlaid yarn 12 into the fabric.

After the stitch transfer (shown at (c)), all stitches are knitted as shown in (d) then a second course of inlay yarn 22 is laid into the fabric as shown at (e). This inlay course is woven into the fabric by transferring the second stitch (on 19) of each pair on the back bed B to the corresponding needle 25 on the front bed F and at the same time transferring the second stitch (on 21) on the front bed to needle 26 on the back bed as at (f). Thereafter the next course is knitted by knitting all the stitches as shown in (g) of FIG. 4.

A third course of inlay yarn 27 is laid into the fabric as shown in (h) and the first stitch of each of the pairs of stitches on needles 23 and 24 are transferred to the other bed as shown in (i). All stitches are then knitted as one course as shown in (j) and a fourth inlay yarn 28 is laid into the fabric as shown at (k). This course of inlay yarn 28 is woven into the fabric by transferring the second stitches on needles 25 and 26 of each pair of stitches to the other bed as shown in (l) and knitting a further course of all the stitches on needles 18, 19, 20 and 21. Steps (a) to (l) are then repeated.

Figure 5A:
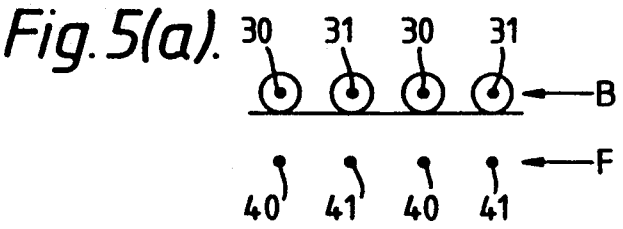
Figure 5B:
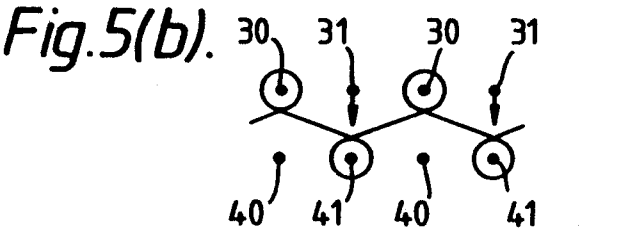
Figure 5C:
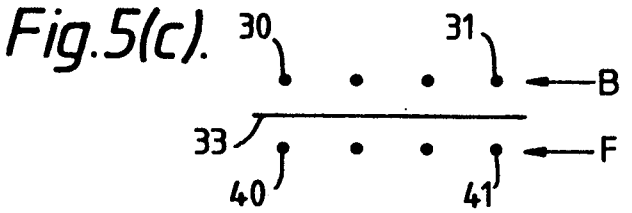
Figure 5D:
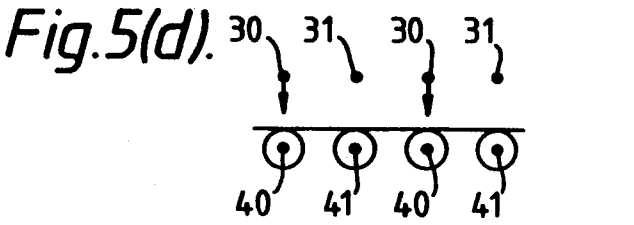
Figure 5E:
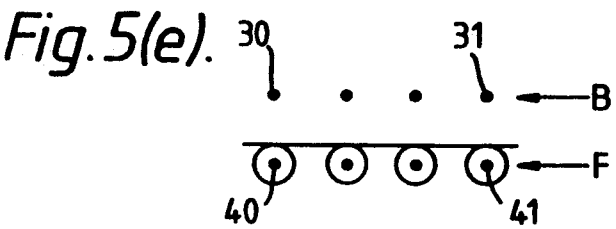
Figure 5F:
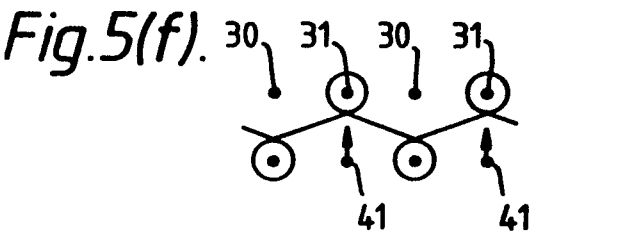
Figure 5G:
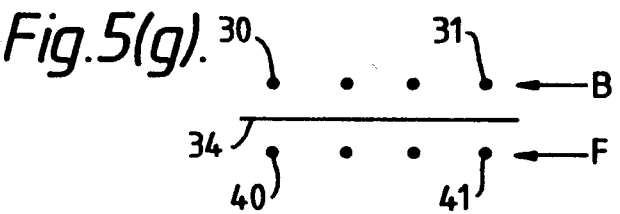
Figure 5H:
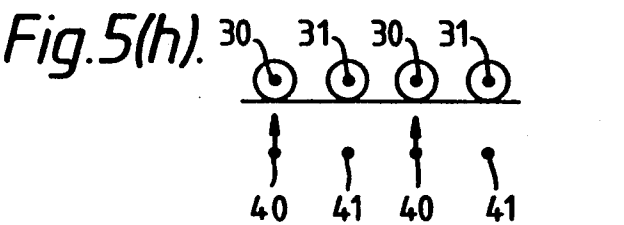

Referring to FIG. 5 there is shown a method of knitting a simulated woven fabric using 1×1 purl knitting. A first single jersey is knitted on active needles 30, 31 of the back bed B of needles only, then stitches on alternate needles 31 of the back bed are transferred to alternate needles 41 of the front bed of needles as shown in (b).

A first inlay thread or yarn 33 is laid into the fabric as shown in (c) of FIG. 5, then the stitches on the needles 30 of the back bed of needles are transferred to the needles 40 on the front bed as shown at (d) and a second course of single jersey is knitted on the front bed of needles as shown at (e). Stitches on alternate needles 41 of the front bed are then transferred to needles 31 of the back bed as shown at (f).

A second inlay thread or yarn 34 is then laid in the fabric as shown in (g) and then the remaining stitches on needles 40 of the front bed of needles are transferred to the needles 30 of the back bed. Then a course of single jersey is knitted on the needles of the back bed and steps (a) to (h) are repeated to obtain a fabric of the desired length.

There are many other variations of stitching that can be performed whilst embodying the inventive concept of incorporating or "weaving" inlaid yarn into the knitted structure.

In the above examples the whole width of the fabric is produced with the same pattern, however it is to be understood that different patterns may be embodied on the same courses providing that the inlay yarn occurs at the same course. The inlay yarn need not be laid for the full length of a course.

It is to be understood that any combination of natural or synthetic fibres, threads or filaments which are knittable can be used to knit the ground structure and any natural or synthetic thread, monofilament, yarn, tape, string or strip of sheet material can be used as the inlay even if it is itself not capable of forming a looped knitted structure.

Successful fabrics have been produced where the inlaid courses are carbon fibres which normally are impossible to knit but which, to our surprise, can be woven into the fabric in accordance with the present invention. Other inlay materials which are suitable are glass fibre filaments, aromatic polyamide fibres such as "Kevlar" (trade mark of DuPont), blends of stretch broken thermoplastic fibres and carbon fibres, such as "Filmix" yarns, (a trade mark of Courtaulds plc).

In the above examples, the knitting has been carried out on a double flat bed or V-bed machine. The same method can be used on a double needle bed circular rib machine. For knitting tubular fabrics on a flat bed machine the needles are set in quarter gauge so that there are effectively two sets of needles in each bed, and each set comprises a plurality of pairs of needles; one of each pair being an active needle and the other an inactive needle in each course. The two sets of needles in each course are employed to knit simultaneously two circumferentially spaced regions of the tubular fabric.

Some advantages of the present invention are as follows:

(a) Fabric can be produced flat or tubular.

(b) Shaped products, e.g. garments, structural reinforcing shapes and preshaped resin impregnated composites can be made.

(c) Fabrics made in accordance with the methods of FIGS. 1 to 4 will not curl because the inlay material is evenly distributed on the front and rear of the fabric.

(d) Fabrics can be made with inlay material over small extents or larger extents of the fabric, and (e) The inlay can be used for decorative effect in fashion inlay as structural strengtheners extending in preferred directions for ballistic resistant fabrics and for high strength industrial fabrics (e.g. glass fibre, polyester, polyamide aramids and carbon fibre or metal wire reinforced fabrics).

In the above examples the stitches are transferred from active needles to inactive needles, however it is to be understood that one can transfer stitches from an active needle to another active needle providing that the existing stitch loop that is on the needle which is to receive the transferred stitch is retained on the needle and not dropped. Both stitches on the receiving needle would be knitted together during the next knitted course.

In the above examples stitches are transferred simultaneously from both beds to the other bed. However, it is possible to transfer stitches from only one bed at a time. This would have the effect of pushing the inlay thread or fabric to one face of the knitted fabric.

The size of the yarns and threads could be different to that mentioned above. For example the yarn of the ground structure may be thicker than that of the inlay material.

I claim:

1. In a method of knitting an inlaid fabric on a knitting machine having first and second needle beds over a predetermined knitting cycle comprising the steps of creating a ground structure of loops extending between the first and second beds of needles, laying inlay material onto the said loops between the needles of both beds of needles at at least one selected stage in the knitting cycle, and trapping inlay material into the ground structure by transferring stitches from one bed to another, the improvement which comprises knitting the fabric on both beds of needles during the knitting cycle interlacing inlay material into the ground structure at one location by transferring stitches at least from the first of the beds to the second of the beds and interlacing inlay material into the ground structure at a further location spaced apart from said one location in the direction of knitting by transferring stitches at least from the second bed to the first bed.

2. A method according to claim 1, which includes knitting one course on needles of both beds, laying at least one thread or yarn into the fabric, then transferring at least some of the stitches of at least one bed of needles to needles of the other bed, and then knitting a further course on the needles of both beds.

3. A method according to claim 1, which includes knitting a first course on needles of both beds, then laying in at least one inlay thread or yarn into the fabric, then knitting a second course on needles of both beds, then transferring the stitches on at least some of the needles of at least one of the beds to needles of the other bed, then laying in at least one second inlay thread or yarn into the fabric, then knitting a third course on needles of both beds, then transferring the stitches on at least some of the needles of at least one of the beds to needles of the other bed.

4. A method according to claim 1, which includes knitting a first course on spaced pairs of needles of both beds, then laying in at least one inlay thread or yarn into the fabric, then transferring the stitches on a first needle of each pair of needles to needles of the other bed, then knitting a second course on needles of both beds, then laying in at least one second inlay thread or yarn into the fabric, then transferring the stitches on the second of each pair of needles to needles of the other bed, then knitting a third course on needles of both beds, then laying in at least one third inlay thread or yarn into the fabric, then transferring the stitches on the first of each pair of needles to needles the other bed, then knitting a fourth course on needles of both beds, then laying in at least one fourth inlay thread or yarn into the fabric and then transferring the stitches on the second of each pair of needles on each bed to needles of the other bed.

5. A method according to claim 1, which includes transferring at least some of the stitches from the first bed to the second bed at a different stage of the knitting cycle from that at which the stitches are transferred from the second bed to the first bed.

6. A method according to claim 1 which includes knitting a first course on needles of one bed, then transferring some stitches from needles of the one bed to needles of the other bed, then laying in at least one inlay thread or yarn onto the loops extending between the beds, then transferring the remaining stitches on the needles of the one bed to needles of the other bed, then knitting a second course on needles of the other bed, then transferring some stitches from needles of the other bed to needles of the one bed, then laying in at least one inlay thread or yarn onto the loops extending between the beds, and then transferring the remaining stitches on the needles of the other bed to needles of the one bed.

7. A method according to claim 1 which includes transferring stitches from needles of one bed which were used to knit an immediately preceding course of knitting to needles of the other bed and using the said needles of the other bed to knit in the next following course of knitting.

8. A method according to claim 1 which includes transferring stitches from needles of one bed which were used to knit in an immediately preceding course of knitting to needles of the other bed which have stitches on them without dropping the existing loops from needles that receive the transferred stitches.

9. A method according to claim 1 which includes transferring at least some of the stitches from each bed to the needles of the other bed in the same course at the same stage of the knitting cycle.

10. A knitted inlaid fabric formed on a knitting machine having first and second needle beds over a predetermined knitting cycle by a method in which a ground structure of loops extending between the first and second beds of needles is created, inlay material is laid onto the said loops between the needles of both beds of needles at at least one selected stage in the knitting cycle, and inlay material is trapped into the ground structure by transferring stitches from one bed to another, and which includes knitting the fabric on both beds of needles during the knitting cycle interlacing inlay material into the ground structure at one location by transferring stitches at least from the first of the beds to the second of the beds and interlacing inlay material into the ground structure at a further location spaced apart from said one location in the direction of knitting by transferring stitches at least from the second bed to the first bed, thereby trapping the inlay material into the knitted fabric without forming a looped structure in said inlay material.

11. A knitted fabric according to claim 10, wherein the inlay material is stronger in tension than the ground structure of the knitted fabric.

12. A composite article comprising a knitted fabric according to claim 10 impregnated with a resin.

13. A composite material comprising a knitted fabric according to claim 10.

* * * * *

UNITED STATES PATENT AND TRADEMARK OFFICE

CERTIFICATE OF CORRECTION

PATENT NO. : 5,299,435

DATED : April 5, 1994

INVENTOR(S) : Sylvan A. Whalley

It is certified that error appears in the above-identified patent and that said Letters Patent is hereby corrected as shown below:

Col. 3, line 35, cancel "1a" and substitute --18--.

Signed and Sealed this

Fourth Day of October, 1994

*Attest:*

*Attesting Officer*

Bruce Lehman

BRUCE LEHMAN

*Commissioner of Patents and Trademarks*